US006257334B1

(12) United States Patent
Cyr et al.

(10) Patent No.: US 6,257,334 B1
(45) Date of Patent: Jul. 10, 2001

(54) STEAM-ASSISTED GRAVITY DRAINAGE HEAVY OIL RECOVERY PROCESS

(75) Inventors: Ted Cyr, Edmonton; Roy Coates, Sherwood Park; Marcel Polikar, Edmonton, all of (CA)

(73) Assignee: Alberta Oil Sands Technology and Research Authority

( * ) Notice: Subject to any disclaimer, the term of this patent is extended or adjusted under 35 U.S.C. 154(b) by 0 days.

(21) Appl. No.: 09/359,582

(22) Filed: Jul. 22, 1999

(51) Int. Cl.[7] ..... E21B 43/24

(52) U.S. Cl. ..... 166/272.7; 166/263; 166/272.3; 166/272.4; 166/306

(58) Field of Search ..... 166/50, 245, 263, 166/272.3, 272.4, 272.7, 303, 306

(56) References Cited

U.S. PATENT DOCUMENTS

| | | | | |
|---|---|---|---|---|
| 2,365,591 | * | 12/1944 | Ranney | 166/306 X |
| 3,771,598 | * | 11/1973 | McBean | 166/272.3 X |
| 4,022,279 | * | 5/1977 | Driver | 166/306 X |
| 4,344,485 | | 8/1982 | Butler | 166/271 |
| 4,463,988 | * | 8/1984 | Bouck et al. | 166/272.7 X |
| 4,466,485 | | 8/1984 | Shu | 166/272 |
| 4,574,884 | | 3/1986 | Schmidt | 166/263 |
| 4,577,691 | * | 3/1986 | Huang et al. | 166/272.7 X |
| 4,598,770 | * | 7/1986 | Shu et al. | 166/272.7 X |
| 4,700,779 | * | 10/1987 | Huang et al. | 166/263 |
| 4,850,429 | * | 7/1989 | Mims et al. | 166/245 |
| 5,016,709 | * | 5/1991 | Combe et al. | 166/272.3 X |
| 5,033,546 | * | 7/1991 | Combe | 166/245 |
| 5,215,146 | * | 6/1993 | Sanchez | 166/306 X |
| 5,244,041 | * | 9/1993 | Renard et al. | 166/272.3 X |
| 5,273,111 | * | 12/1993 | Brannan et al. | 166/272.7 X |
| 5,318,124 | | 6/1994 | Ong et al. | 166/263 |
| 5,417,283 | | 5/1995 | Ejiogu et al. | 166/272 |
| 5,860,475 | * | 1/1999 | Ejiogu et al. | 166/272.7 X |
| 5,957,202 | * | 9/1999 | Huang | 166/272.3 |

FOREIGN PATENT DOCUMENTS

| | | | |
|---|---|---|---|
| 1130201 | | 8/1982 | (CA) . |
| 1304287 | * | 6/1992 | (CA) . |
| 2096034 | | 7/1996 | (CA) . |

* cited by examiner

*Primary Examiner*—George Suchfield
(74) *Attorney, Agent, or Firm*—Marsh Fischmann & Breyfogle LLP

(57) ABSTRACT

A pair of vertically spaced, parallel, co-extensive, horizontal injection and production wells and a laterally spaced, horizontal offset well are provided in a subterranean reservoir containing heavy oil. Fluid communication is established across the span of formation extending between the pair of wells. Steam-assisted gravity drainage ("SAGD") is then practised by injecting steam through the injection well and producing heated oil and steam condensate through the production well, which is operated under steam trap control. Cyclic steam stimulation is practised at the offset well. The steam chamber developed at the offset well tends to grow toward the steam chamber of the SAGD pair, thereby accelerating development of communication between the SAGD pair and the offset well. This process is continued until fluid communication is established between the injection well and the offset well. The offset well is then converted to producing heated oil and steam condensate under steam trap control as steam continues to be injected through the injection well. The process yields improved oil recovery rates with improved steam consumption.

6 Claims, 8 Drawing Sheets

FIG. 1 *(Prior Art)*
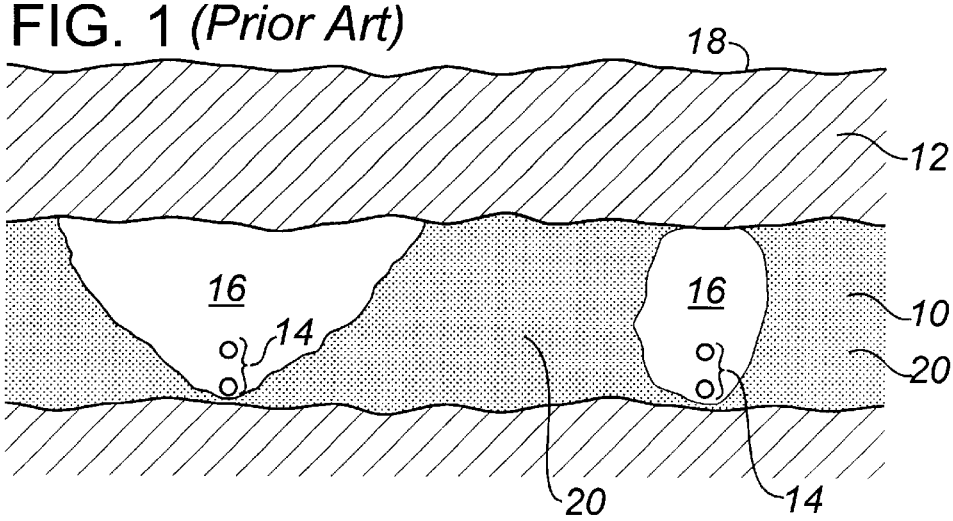
FIG. 2
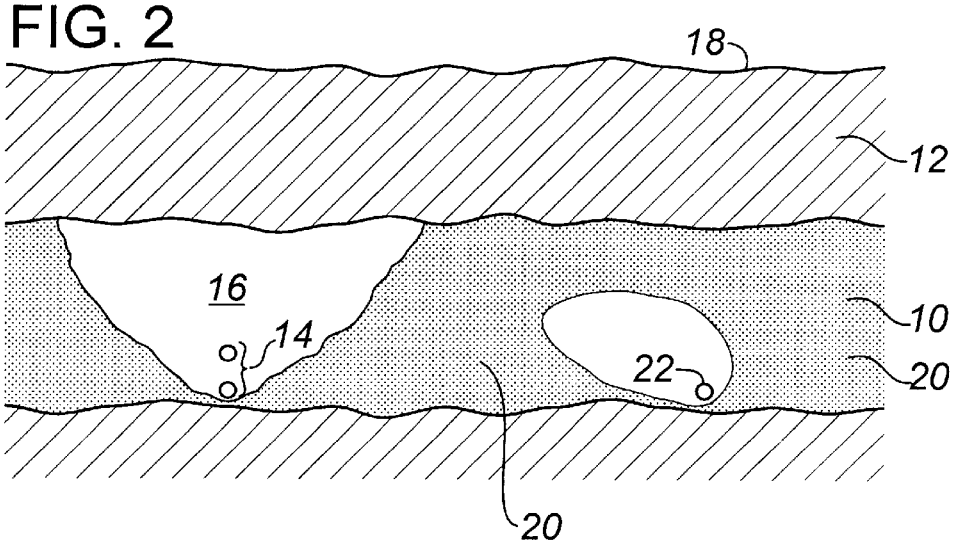
FIG. 3
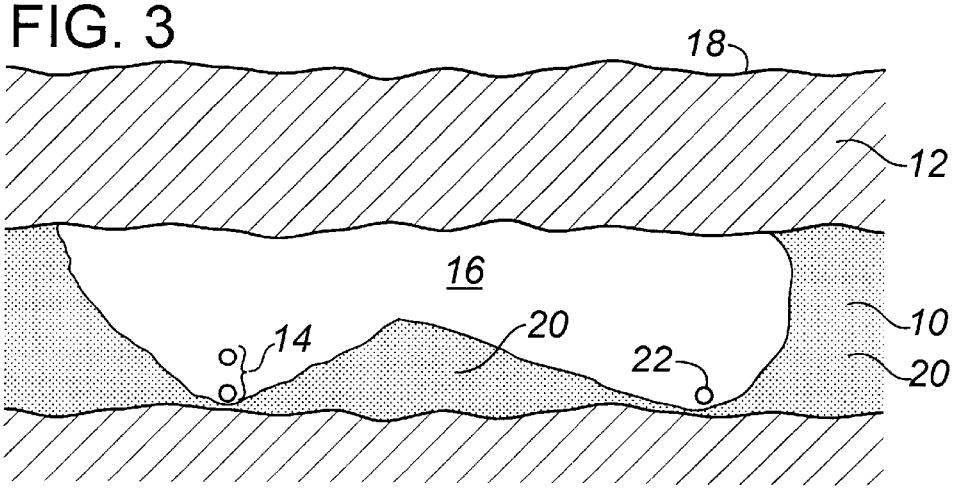

| d(m) | di(m) |
|---|---|
| 50 | 1 |
| 60 | 1.32 |
| 70 | 1.65 |
| 80 | 1.97 |
| 90 | 2.29 |
| 100 | 2.61 |

200-250°C
150-200°C
100-150°C
50-100°C
0-50°C
14
22

200-250°C
150-200°C
100-150°C
0-50°C
50-100°C 200-250°C
150-200°C
100-150°C
50-100°C
0-50°C 200-250°C
50-100°C
100-150°C
150-200°C
0-50°C 200-250°C
150-200°C
100-150°C
50-100°C 200-250°C
150-200°C
100-150°C
50-100°C 200-250°C
150-200°C
100-150°C 200-250°C
150-200°C 200-250°C
150-200°C

STEAM-ASSISTED GRAVITY DRAINAGE HEAVY OIL RECOVERY PROCESS

TECHNICAL FIELD

This invention relates generally to a process for recovering heavy oil from a subterranean reservoir using a combination of steam-assisted gravity drainage and cyclic steam stimulation.

BACKGROUND ART

Over the past 20 years, there has been an evolution in the thermal processes applied for recovering heavy, viscous oil from subterranean reservoirs in Alberta.

The first commercially applied process was cyclic steam stimulation. This process is commonly referred to as "huff and puff". Steam is injected into the formation, commonly at above fracture pressure, through a usually vertical well for a period of time. The well is then shut in for several months, referred to as the "soak" period. Then the well is opened to produce heated oil and steam condensate until the production rate declines. The entire cycle is then repeated. In the course of the process, an expanding "steam chamber" is gradually developed. Oil has drained from the void spaces of the chamber, been produced through the well during the production phase, and is replaced with steam. Newly injected steam moves through the void spaces of the hot chamber to its boundary, to supply heat to the cold oil at the boundary.

There are problems associated with the cyclic process. More particularly:

- The fracturing tends to occur vertically along a direction dictated by the tectonic regime present in the formation. In the Cold Lake area of Alberta, fracturing tends to occur along a north-east trend;
- When steam is injected, it tends to preferentially move through the fractures and heat outwardly therefrom. As a result, the heated steam chamber that is developed tends to be relatively narrow and extends along this north-east direction from opposite sides of the well;
- Therefore large bodies of unheated oil are left in the zone extending between adjacent wells and their linearly extending steam chambers; and
- The process is not efficient with respect to steam utilization.

Steam/oil ratios are relatively high because the steam is free to be driven down any permeable path.

In summary then, huff and puff gives relatively low oil recovery and the steam/oil ratio is relatively high.

A more recent, successfully demonstrated process involves a mechanism known as steam-assisted gravity drainage ("SAGD").

One embodiment of the SAGD process is described in Canadian patent 1,304,287. This embodiment involves:

- Providing a pair of coextensive horizontal wells spaced one above the other. The spacing of the wells is typically 5–8 meters. The pair of wells is located close to the base of the formation;
- The span of formation between the wells is heated to mobilize the oil contained therein. This may be done by circulating steam through each of the wells at the same time to create a pair of "hot fingers". The span is slowly heated by conductance;
- When the oil in the span is sufficiently heated so that it may be displaced or driven from one well to the other, fluid communication between the wells has been established and steam circulation through the wells is terminated;

- Steam injection at less than formation fracture pressure is now initiated through the upper well and the lower well is opened to produce draining liquid. Injected steam displaces the oil in the inter well span to the production well. The appearance of steam at the production well indicates that fluid communication between the wells is now complete;
- Steam-assisted gravity drainage recovery is now initiated. Steam is injected through the upper well at less than fracture pressure. The production well is throttled to maintain steam trap conditions. That is, throttling is used to keep the temperature of the produced liquid at about 6–10° C. below the saturation steam temperature at the production well. This ensures that a short column of liquid is maintained over the production well, thereby preventing steam from short-circuiting into the production well. As the steam is injected, it rises and contacts cold oil immediately above the upper injection well. The steam gives up heat and condenses; the oil absorbs heat and becomes mobile as its viscosity is reduced. The condensate and heated oil drain downwardly under the influence of gravity, The heat exchange occurs at the surface of an upwardly enlarging steam chamber extending up from the wells. The chamber is fancifully depicted in FIG. 1. The chamber is constituted of depleted, porous, permeable sand from which the oil has largely drained and been replaced by steam.
- The steam chamber continues to expand upwardly and laterally until it contacts the overlying impermeable overburden. The steam chamber has an essentially triangular cross-section. If two laterally spaced pairs of wells undergoing SAGD are provided, their steam chambers grow laterally until they contact high in the reservoir. At this stage, further steam injection may be terminated and production declines until the wells are abandoned.

The SAGD process is characterized by several advantages, relative to huff and puff. Firstly, it is a process involving relatively low pressure injection so that fracturing is not likely to occur. The injected steam simply rises from the injection point and does not readily move off through fractures and permeable streaks, away from the zone to be heated. Otherwise stated, the steam tends to remain localized over the injection well in the SAGD process. Secondly, steam trap control minimizes short-circuiting of steam into the production well. And lastly, the SAGD steam chambers are broader than those developed by fracturing and huff and puff, with the result that oil recovery is generally better. It has been demonstrated the better steamloil ratio and oil recovery can be achieved using the SAGD process.

However there are a number of problems associated with the SAGD process which need addressing. More particularly:

- There is a need to more quickly heat the formation laterally between laterally spaced wells; and
- As previously stated and as illustrated in FIG. 1, the steam chambers produced by pairs of SAGD wells are generally triangular in cross-section configuration. As a result there is unheated and unrecovered oil left between the chambers in the lower reaches of the reservoir (this is indicated by cross-hatching in FIG. 1).

It is the objective of the present invention to provide a SAGD process which is improved with respect to these shortcomings.

SUMMARY OF THE INVENTION

The invention is concerned with a process for recovering heavy viscous oil from a subterranean reservoir comprising the steps of:

(a) providing a pair of spaced apart, generally parallel and co-extensive, generally horizontal steam injection and production wells;

(b) establishing fluid communication between the wells;

(c) practising steam-assisted gravity drainage to recover oil by injecting steam at less than formation fracture pressure (typically at a low pressure that is greater than but close to formation pressure) through the injection well and producing steam condensate and heated oil through the production well while throttling the production well as required to keep the produced liquid temperature less than the steam saturation temperature at the injection well (that is, operating the production well under steam trap control);

(d) providing a horizontal third well, generally parallel and co-extensive with the injection and production wells and preferably located at about the same general elevation as the pair of wells, the third well being laterally offset from the pair of wells, typically at a distance of about 50 to 80 m; and (e) contemporaneously practising cyclic steam stimulation at the offset well, preferably by injecting steam at less than formation fracture pressure, more preferably at a "high" pressure which is greater than that being used at the SAGD pair, and preferably by operating the well during the production phase under steam-trap control conditions, to develop a steam chamber which causes lateral heating of the span of reservoir formation between the pair of wells and the third well and to periodically produce heated oil through the offset well.

Preferably, steps (c) and (e) are continued to establish fluid communication between the injection well and the offset well and then the offset well is converted to production. Steam-assisted gravity drainage procedure is continued with the offset well being operated under steam-trap control to produce part or all of the draining fluid.

The invention utilizes the discovery that practising SAGD and huff and puff contemporaneously at laterally spaced horizontal wells leads to faster developing fluid communication between the two well locations. When SAGD and huff and puff are practised at relatively low and high pressures, there is a greater tendency for the huff and puff steam chamber to grow toward the SAGD steam chamber during the injection phase at the third well. During the production phase at the third well, the injection pressure at the SAGD pair preferably may be increased (while keeping it at less than fracture pressure) to induce lateral growth of the SAGD steam chamber toward the third well.

The invention further utilizes the discovery that:

if SAGD and huff and puff are practised contemporaneously using horizontal wells at laterally spaced locations; and if the huff and puff well is converted to fluid production under steam trap control when fluid communication has been established between the locations;

then more extensive heating of the lower reaches of the reservoir between the locations may be achieved. This leads to greater oil recovery.

The expression "contemporaneously" as used herein and in the claims is to be interpreted to encompass both: (1) simultaneously conducting SAGD and huff and puff steam injection at the two locations; and (2) intermittently and sequentially repetitively conducting SAGD steam injection at the first location and then huff and puff steam injection at the second location, to minimize required steam production facilities.

In another preferred feature, at the stage where fluid communication between the injection well and the offset well have been established and SAGD is being practised using all three wells, a small amount of nitrogen or methane could be injected with the steam. We contemplate using about 1–2% added $N_2$ or $CH_4$ gas. It is anticipated that the added gas will accumulate along chamber surfaces where there is little liquid flow to the producing wells, to thereby reduce heat loss.

It is further contemplated that the invention can be put into practice in a staged procedure conducted across a reservoir by: (a) contemporaneously practising SAGD at a first location and huff and puff at a second laterally spaced location until fluid communication is established; (b) then practising SAGD alone at the first pair, with the third well at the second location being produced; (c) providing SAGD wells at a third location laterally spaced from the second location; and repeating steps (a) and (b) at the second and third locations and repeating the foregoing procedure to incrementally develop and produce the reservoir.

DESCRIPTION OF THE DRAWINGS

FIG. 1 is a fanciful sectional view showing the wells and steam chambers developed by operating spaced apart, side-by-side pairs of wells practising SAGD in accordance with the prior art;

FIGS. 2 and 3 are fanciful sectional views showing the wells and steam chambers developed by practising SAGD and cyclic stimulation in tandem at laterally offset locations in the initial (FIG. 2) and mature stages (FIG. 3);

DESCRIPTION OF THE PREFERRED EMBODIMENT

The steps of providing suitably completed and equipped horizontal wells and operating them to practice SAGD and huff and puff are within the ordinary skill of those experienced in thermal SAGD and huff and puff operations; thus they will not be further described herein.

The discoveries underlying the present invention were ascertained in the course of computer numerical simulation modeling studies carried out on various combinations of thermal recovery procedures, with a view to identifying a process that would yield better recovery in less time than prior art processes.

Two procedures tested are relevant to the present invention and are now described.

Figure 4:
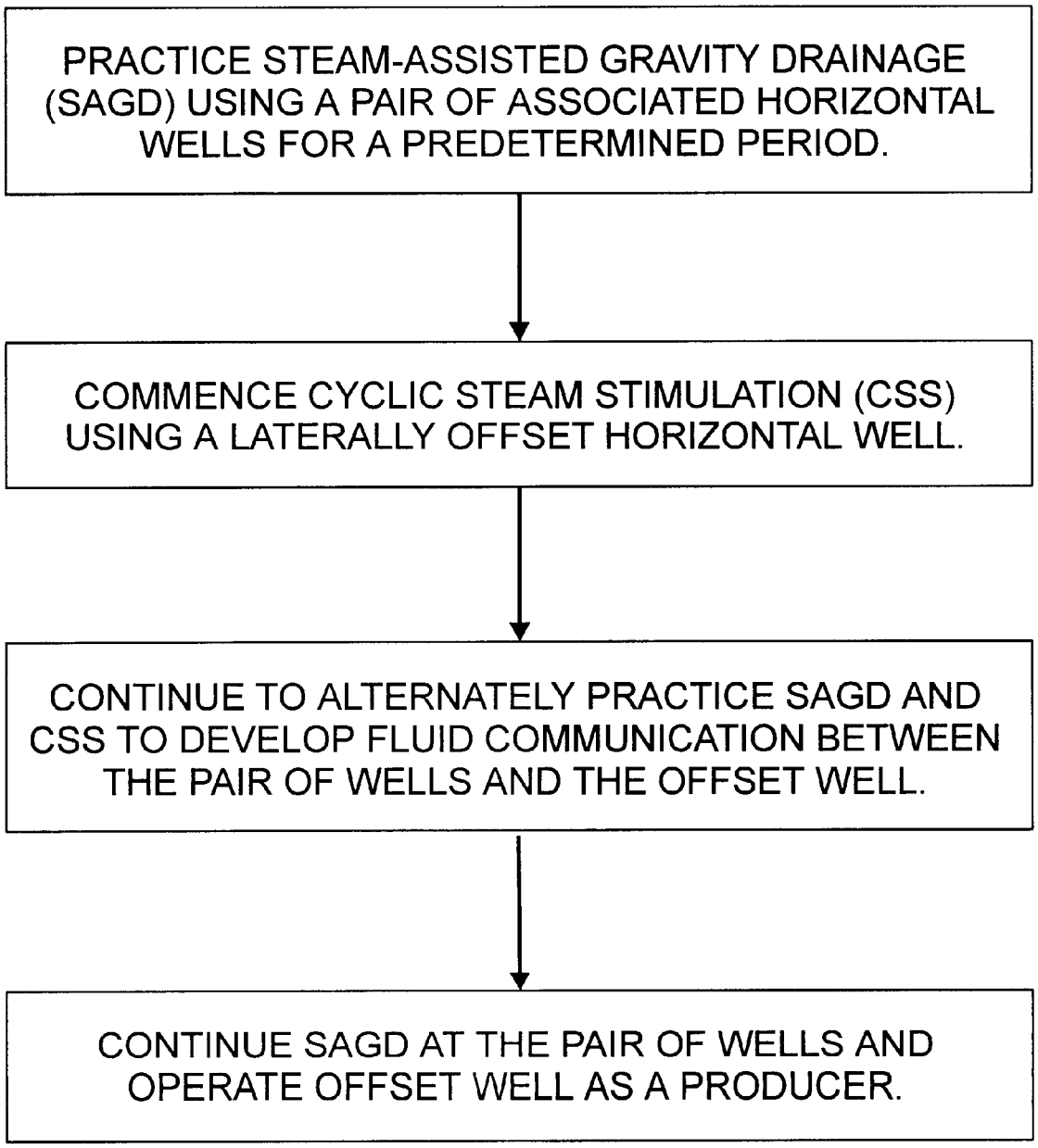
FIG. 4 is a block diagram setting forth the steps of the present invention.
Figure 5:
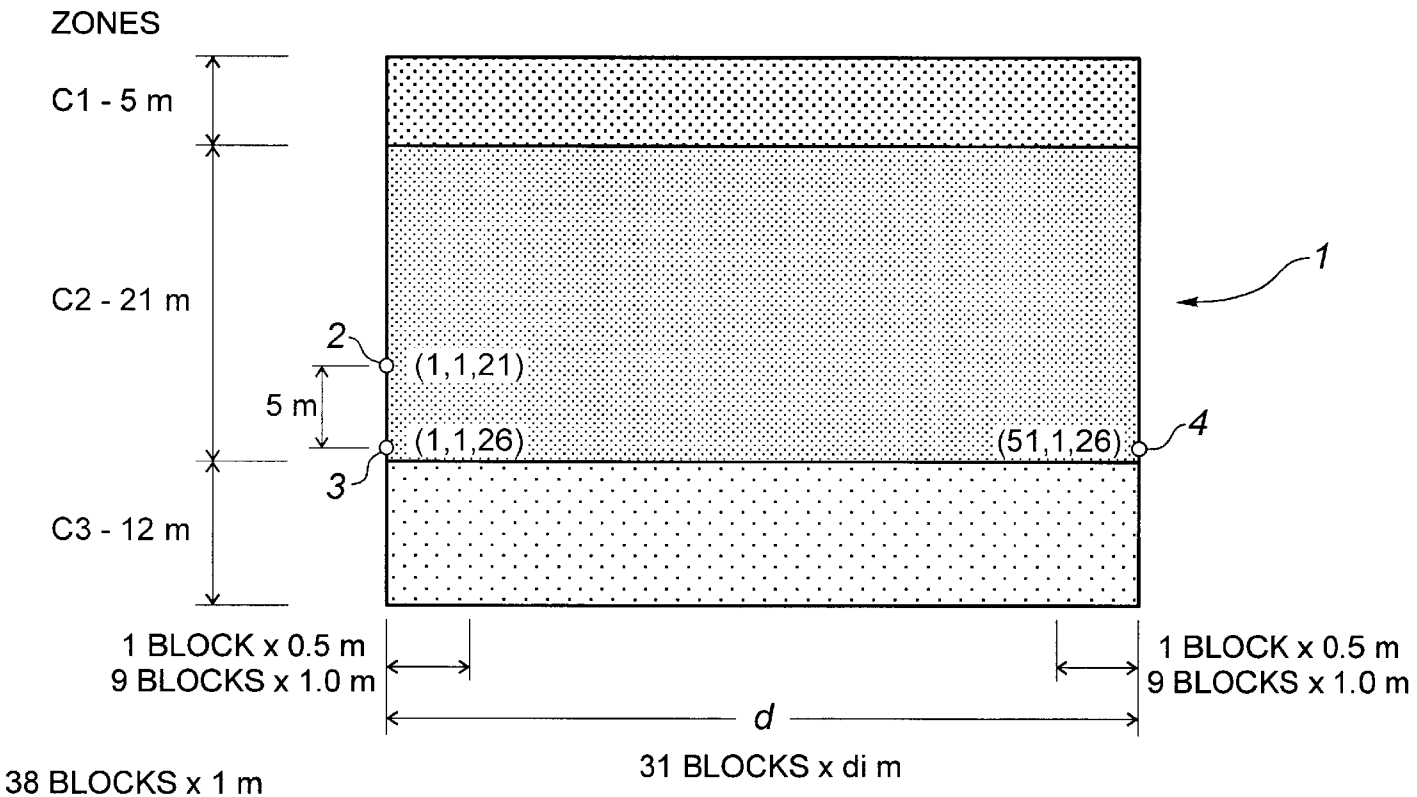
FIG. 5 is a numerical grid configuration used in numerical simulation runs in developing the present invention.
Figure 6:
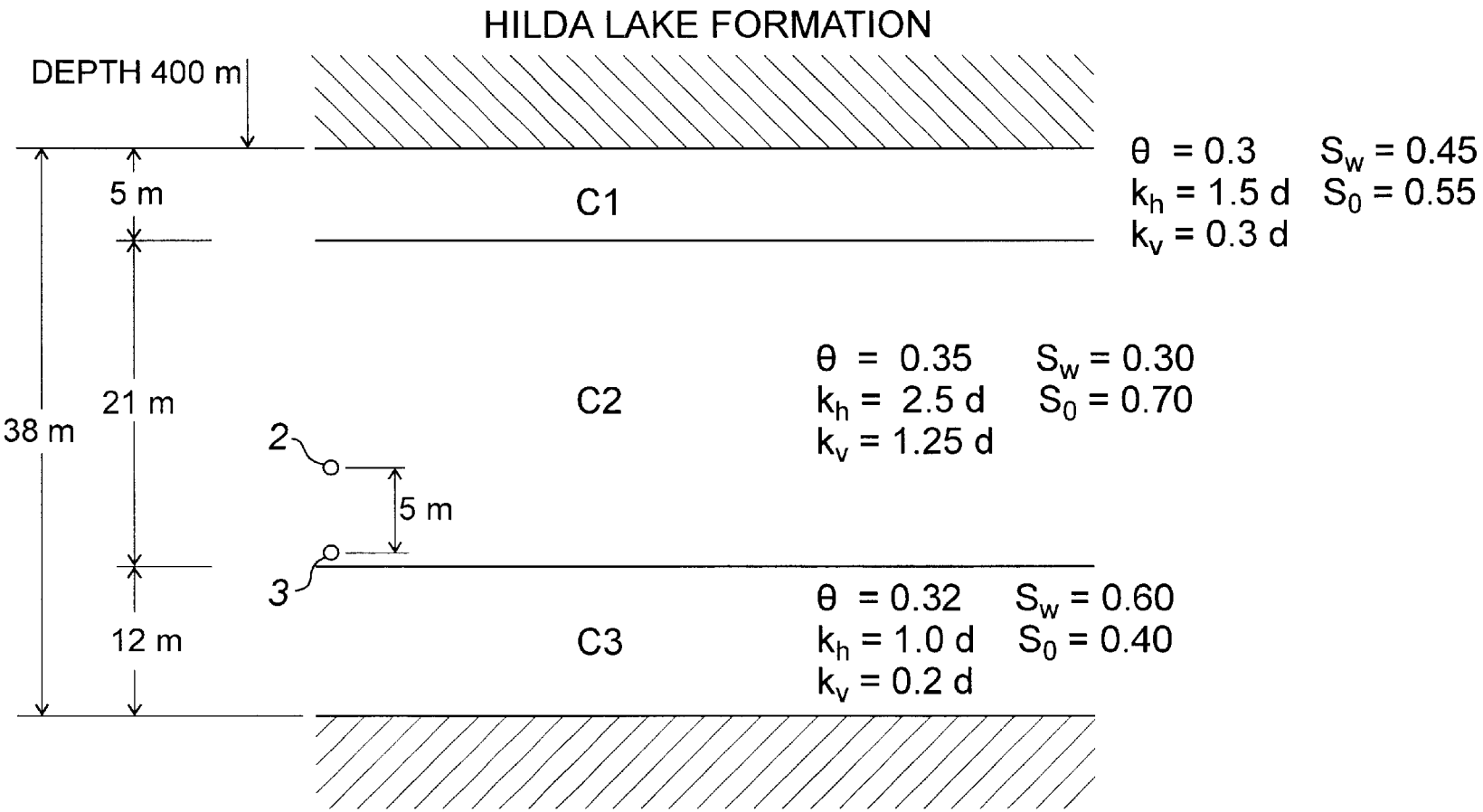
FIG. 6 is a plot setting forth the reservoir characteristics for three layers making up the grid of FIG. 3.
Figure 7A:
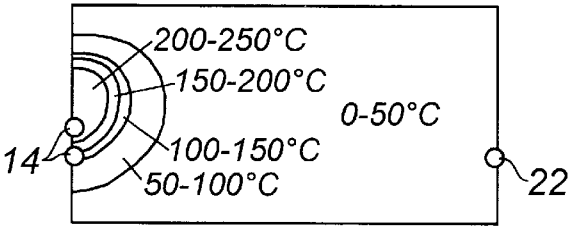
FIG. 7 is a plot of a series of temperature profiles developed by a numerical simulation run over time in the grid by practising the baseline case of SAGD operation only at the left hand side of the grid.
Figure 7B:
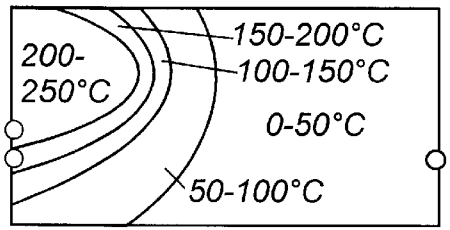
Figure 7C:
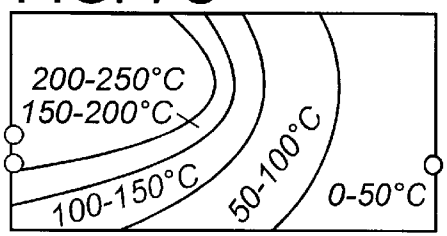
Figure 7D:
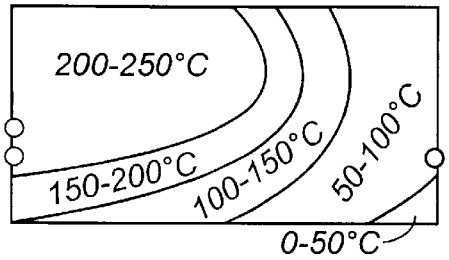
Figure 7E:
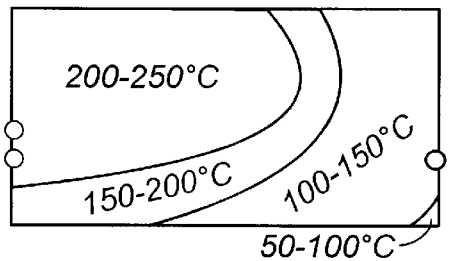
Figure 7F:
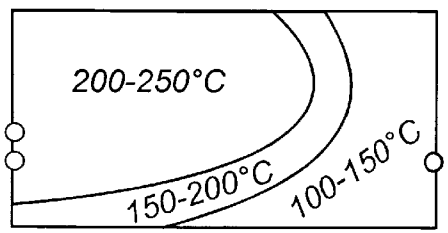

In the first procedure, referred to as the baseline case, numerical simulation runs were carried out using a rectangular numerical grid 1 (see FIG. 5) representative of a block of oil reservoir existing in the Hilda Lake region of Alberta. The grid was assigned 60 meters in width and was divided into three layers (C1, C2 and C3) which were assigned thicknesses and reservoir characteristics, as set forth in FIG. 6. These values generally agreed with the characteristics of the actual reservoir and were used in the simulation. The model further incorporated a pair of horizontal, vertically spaced upper injection and lower production wells 2, 3 as shown in FIG. 5. The wells 2, 3 were located at the left margin of the grid 1. The baseline case was assigned the following reservoir conditions:

| | |
|---|---|
| initial temperature: | 18 ° C. |
| initial pressure | 3100 kPa |
| GOR: | 11 |
| oil viscosity: | 10,000 cp |
| initial water immobile. | |

Fluid communication between wells 2, 3 was developed by practising a 52 day preheat involving simulation of steam circulation in both wells 2 and 3 by adding heat to the grid containing the wells.

SAGD operation was initiated at the pair of wells 2, 3 using the following operating parameters:

| | |
|---|---|
| Maximum injection pressure | 3110 kPa |
| Maximum injection rate | 500 $m^3$/d |
| Steam quality | 95% |
| Minimum production pressure | 3100 kPa with steam trap control. |

FIG. 7 shows periodic temperature profiles for a numerical simulation run carried out over a hypothetical 15 year period.

In the second procedure, referred to as the 'combination case', runs were carried out by:

- practising SAGD for several years at the pair of wells at the left hand side of the grid;
- then initiating huff and puff (cyclic steam stimulation) at an offset well 4 located at the right hand side of the grid; and
- thereafter periodically alternating huff and puff at well 4 and SAGD at wells 2, 3 (it was assumed that steam capacity was only sufficient to inject steam at the two sides of the grid in alternating fashion).

Two runs were carried out according to the combination case procedure under the following conditions. The first run was carried out at relatively mild conditions of steam injection pressure and rate and the second run at more aggressive conditions. More particularly:

$1^{st}$ run (SAGD+huff and puff—mild conditions):

- Maximum injection pressure—5000 kPa;
- Maximum injection rate—500 $m^3$/d;
- (Both the pressure and injection rate varied. To start, the injection rate was 500 $m^3$/d and the initial pressure was 3100 kPa. As steam was injected, the formation pressure around the well would increase to a maximum of 5000 kPa, at which point the injection rate would reduce to maintain this pressure. As injectivity was increased through heating, the pressure would drop and the injection rate would increase to the maximum of 500 $m^3$/d);
- Steam quality—95%;
- Minimum production pressure—3100 kPa with steam trap control;
- Two injection/production cycles at the offset well. One month of injection followed by two months of production followed by three months of injection followed by three months of production, at which time the offset well was converted to full time production under steam trap control;
- Offset well distance—60 m;
- Start huff and puff after 3 years of initial SAGD only. Huff and puff duration was nine months. For the remainder of the run, SAGD was practised with the offset well acting as a second SAGD production well.

$2^{nd}$ Run (SAGD+huff and puff—aggressive conditions):

- Same conditions as the $1^{st}$ run except for the following:
  - Maximum injection pressure—10,000 kPa
  - Maximum injection rate—1000 $m^3$/d
  - Nine months of injection followed by three months of production followed by six months of injection followed by three months of production at which time the offset well was converted to full time production under steam trap control;
  - Offset well distance—60 m;
  - Start huff and puff after 3 years of initial SAGD only. Huff and puff duration was nineteen months. For the remainder of the run, SAGD was practised with the offset well acting as a second SAGD production well.
  - It will be noted that the two runs differed in the following respects:

| $1^{st}$ Run: | $2^{nd}$ Run: |
|---|---|
| short cycle | longer cycle |
| low injection rate | higher injection rate |
| low pressure | higher pressure. |

Figure 10:
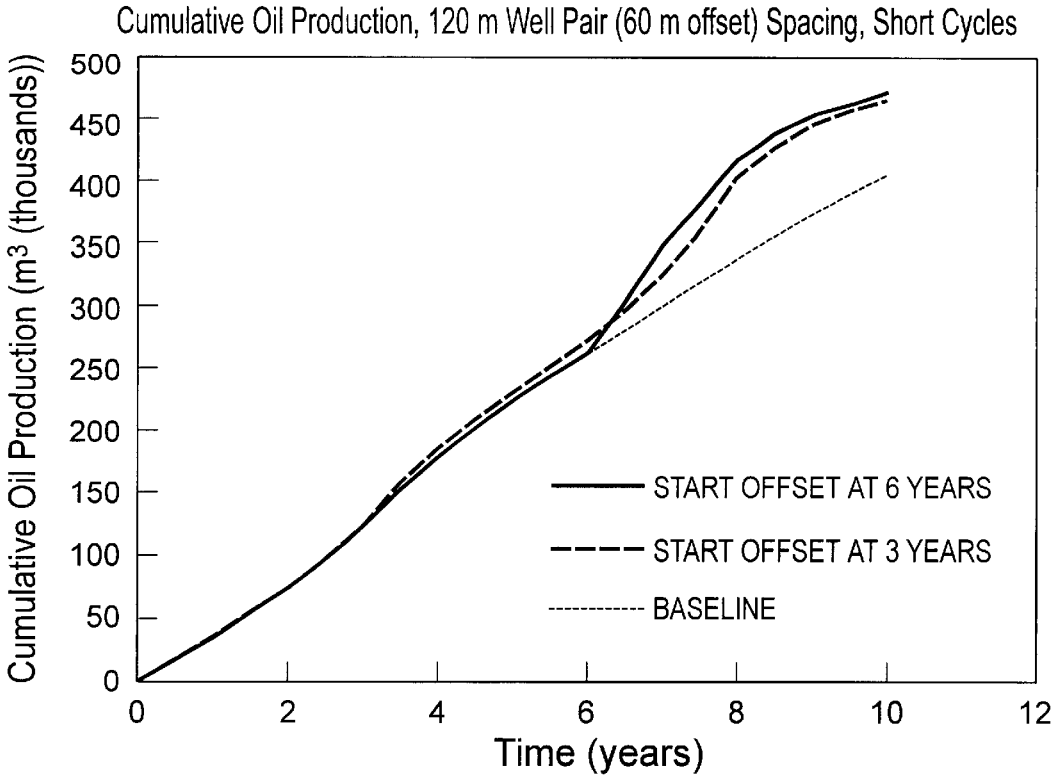
FIG. 10 is a plot of cumulative oil production over time for the run carried out in accordance with the base line case and the two runs carried out in accordance with the combination case, all runs being carried out at mild conditions and, in the case of the first combination run, with offset huff and puff commencing after 3 years and, in the case the case of the second combination run, with offset huff and puff commencing after 6 years.

Having reference now to FIG. 10, it will be noted that there was an incremental improvement in rate of oil recovery between the combination and baseline cases, commencing after about 6 years, when mild conditions of steam injection pressure and rate were applied.

Figure 11:
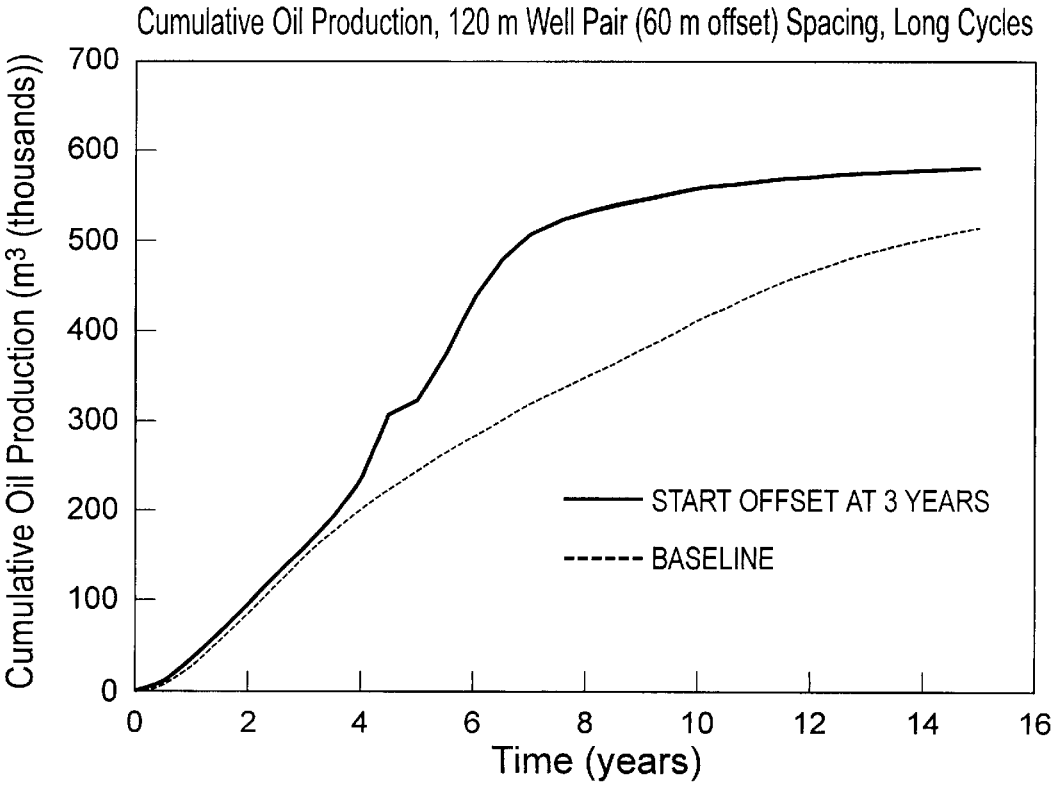
FIG. 11 is a plot of cumulative oil production over time for the run carried out in accordance with the combination case at aggressive conditions with offset huff and puff commencing after 3 years.

Having reference to FIG. 11, it will be noted that there was a larger incremental improvement in rate of oil recovery between the combination and baseline cases, commencing after about 3 years, when the more aggressive conditions of steam injection pressure and rate were applied.

FIGS. 10 and 11 show both an improved amount of oil recovery and an improved rate of recovery.

Figure 8A:
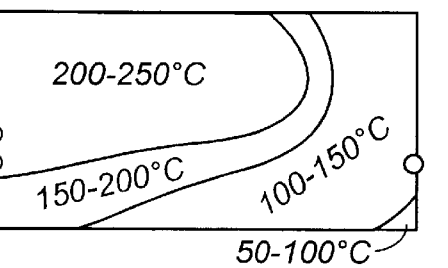
FIG. 8 is a plot of a series of temperature profiles developed by a numerical simulation run over time in the grid by practising SAGD only for 6 years and then alternating SAGD and huff and puff using an offset well, under mild conditions.
Figure 8B:
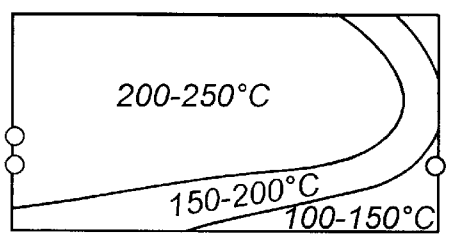
Figure 8C:
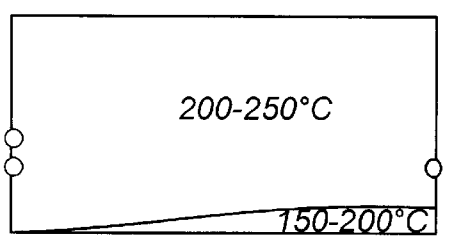
Figures 9A, 9B, 9C, 9D, 9E, 9F, 9G, 9H, 9I:
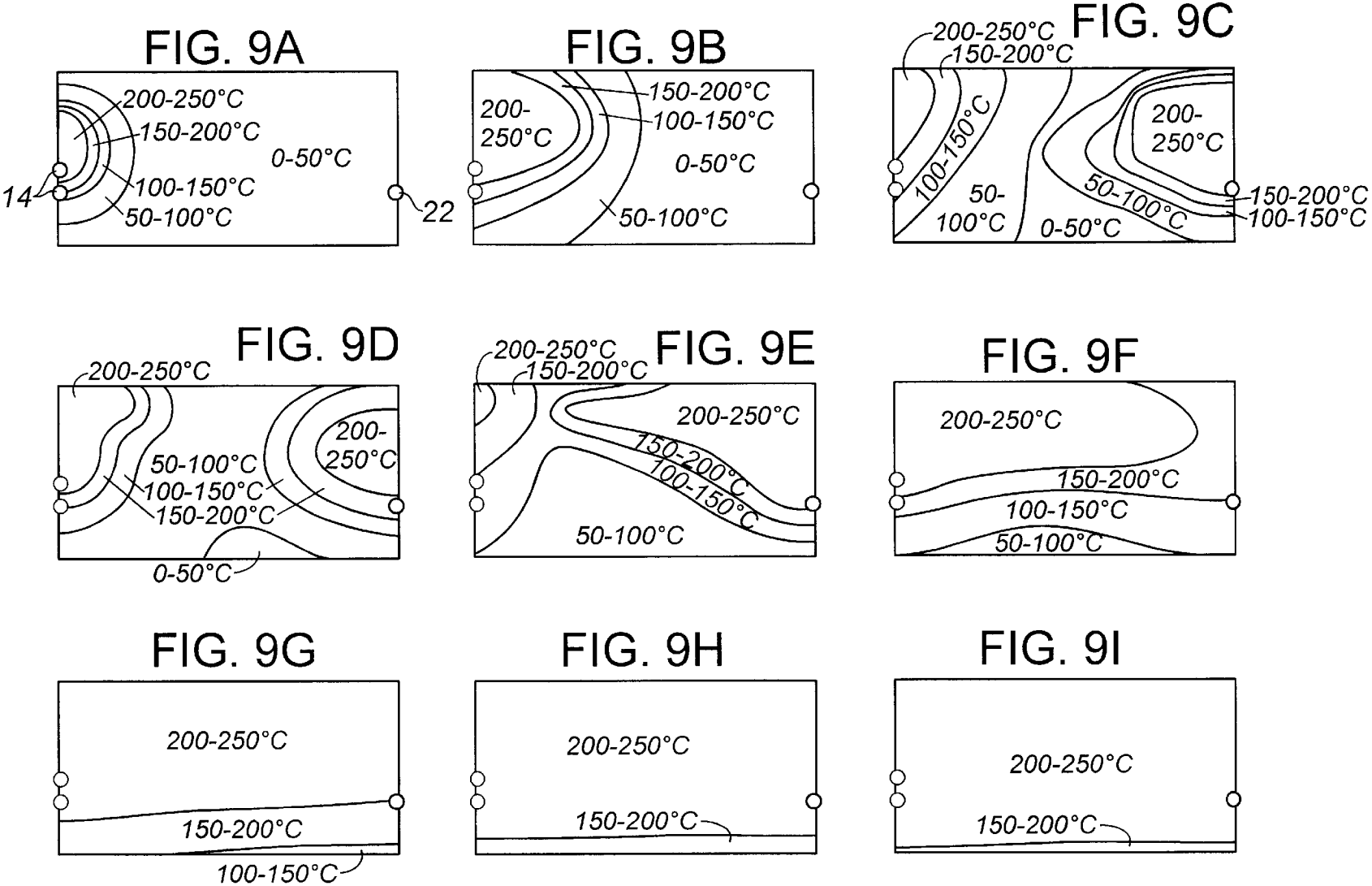
FIG. 9 is a plot of a series of temperature profiles developed by a numerical simulation run over time in the grid by practising SAGD only for 3 years and then alternating SAGD and huff and puff using an offset well, under aggressive conditions.

Having reference to FIGS. 7, 8 and 9, it will be noted:

that a comparison of the temperature contours at the ninth, twelfth and fifteenth years of operation for the baseline and combination cases (the latter involving huff and puff operation commencing at the sixth year) with mild steam injection pressure and rate, showed improved lateral extension of the high temperature contour in the combination case; and that a comparison of the temperature contours at the end of nine years of operation of the baseline and combination cases at aggressive steam injection pressure and rate showed only partial lateral extension of the highest temperature contour in the baseline case but complete lateral extension in the combination case.

Figure 12:
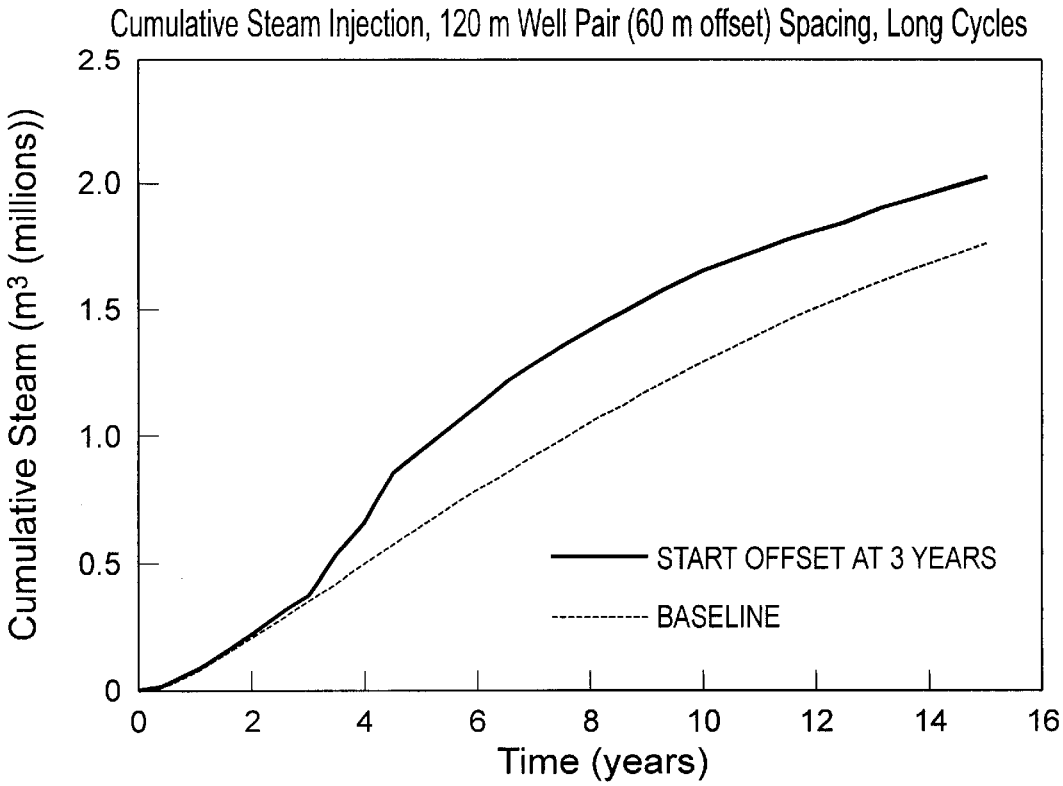
FIG. 12 is a plot showing cumulative steam injection for each of the baseline and combination case runs operated at aggressive conditions.
Figure 13:
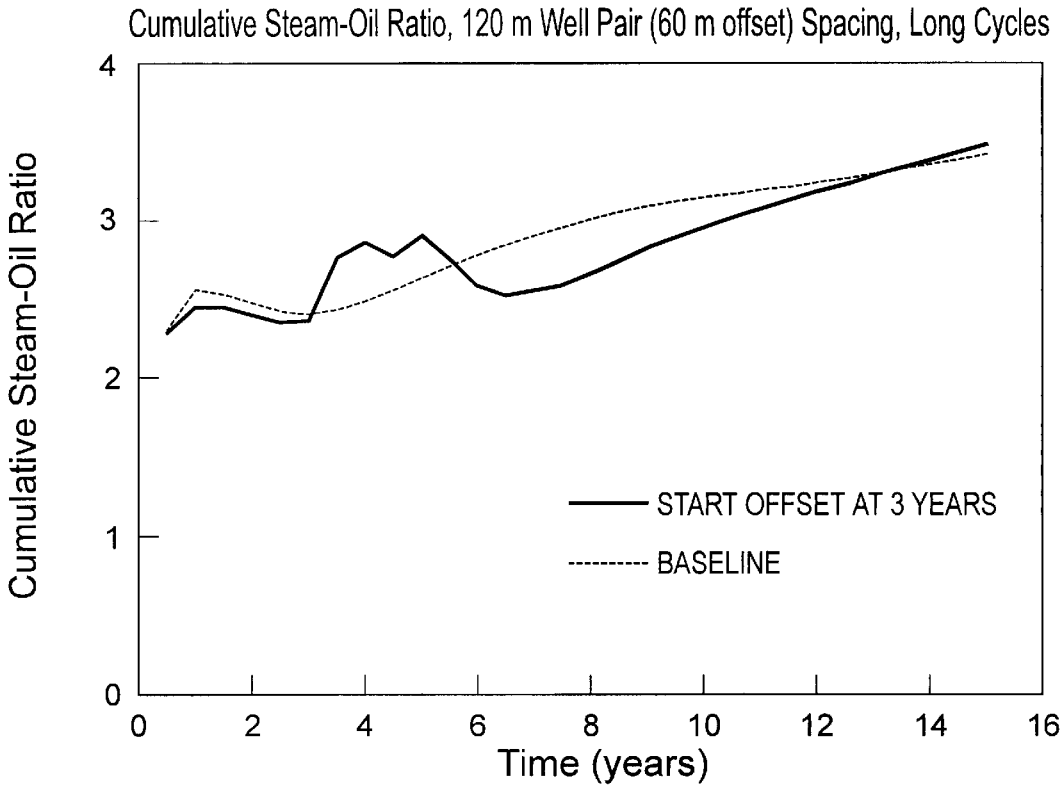
FIG. 13 is a plot showing the steam/oil ratio for each of the baseline and combination case runs operated at aggressive conditions.

Having reference to FIGS. 11 and 12 it will be noted:

that it took about 7 years for the combination case and 14 years for the baseline case to produce 500,000 $m^3$ of oil; and that the steam consumed by 7 years of combination case operation was about 125,000 $m^3$ to produce the 500,000 $m^3$ of oil, whereas the steam consumed by 14 years of baseline operation was about 165,000 $m^3$ to produce the same amount of oil. (This is reiterated by FIG. 13.)

In other words, the combination case was more efficient in terms of steam utilization.

In summary then, the experimental numerical simulation run data establishes that:

faster lateral heating of the reservoir;

greater oil recovery;

faster oil recovery; and improved steam consumption efficiency; are achieved by the combination case when compared with the baseline case.

The embodiments of the invention in which an exclusive property or privilege is claimed are defined as follows:

1. A thermal process for recovering heavy viscous oil from a subterranean reservoir, comprising:

(a) providing a pair of spaced apart, generally parallel and co-extensive, generally horizontal steam injection and production wells;

(b) establishing fluid communication between the wells;

(c) practising steam-assisted gravity drainage to recover oil by injecting steam at less than formation fracture pressure through the injection well and producing steam condensate and heated oil through the production well while throttling the production well to keep the produced liquid temperature less than the steam saturation temperature at the injection well;

(d) providing a generally horizontal third well, offset from and generally parallel and co-extensive with the injection and production wells; and (e) contemporaneously practising cyclic steam stimulation at the offset well to develop lateral heating of the span of reservoir formation between the pair of wells and the third well and periodically producing heated oil and steam condensate therethrough.

2. The process as set forth in claim 1 comprising:

continuing steps (c) and (e) to establish fluid communication between the injection well and the third well; and then continuing to inject steam through the injection well and produce heated oil and steam condensate through the third well while throttling the third well to keep the produced liquid temperature less than the steam saturation temperature at the injection well.

3. The process as set forth in claim 1 comprising throttling the third well during cyclic stimulation to keep the produced liquid temperature less than the steam saturation temperature at the injection well.

4. The process as set forth in claim 2 comprising injecting a small amount of nitrogen or methane together with the steam after fluid communication has been established between the injection well and the third well.

5. The process as get forth in claim 2 comprising throttling the third well during cyclic stimulation to keep the produced liquid temperature less than the steam saturation temperature at the injection well and injecting a small amount of nitrogen or methane together with the steam after fluid communication has been established between the injection well and the third well.

6. The process as set forth in claim 2 comprising throttling the third well during cyclic stimulation to keep the produced liquid temperature less than the steam saturation temperature at the injection well.

* * * * *